US005806682A

United States Patent [19]

Mecca et al.

[11] Patent Number: 5,806,682

[45] Date of Patent: Sep. 15, 1998

[54] COMPACT WITH RE-USEABLE, SELF-ALIGNING VALVE SEAL

[76] Inventors: Anna Mecca, 541 Art La., Ridgefield, N.J. 07657; John J. Slink, 23 Sheephill Rd., Grenwhich, Conn. 06878

[21] Appl. No.: 760,736

[22] Filed: Dec. 6, 1996

[51] Int. Cl.[6] ..... B65D 69/00

[52] U.S. Cl. ..... 206/581; 206/823; 220/DIG. 26

[58] Field of Search ..... 206/581, 823, 206/470, 472, 486.488; 220/DIG. 26, 337, 338

[56] References Cited

U.S. PATENT DOCUMENTS

| | | | |
|---|---|---|---|
| 1,690,275 | 11/1928 | Coryell | 220/DIG. 26 |
| 1,989,155 | 1/1935 | Rosenberg | 220/DIG. 26 |
| 2,128,737 | 8/1938 | Aronstein | 220/DIG. 26 |
| 2,358,270 | 9/1944 | Wild | 206/823 |
| 2,362,120 | 11/1944 | Swart | 220/DIG. 26 |
| 5,220,999 | 6/1993 | Goulette | 206/470 |
| 5,325,961 | 7/1994 | Ford et al. | 206/470 |
| 5,395,015 | 3/1995 | Bolen, Jr. et al. | 220/338 |
| 5,542,561 | 8/1996 | Slink et al. | 206/581 |

*Primary Examiner*—Paul T. Sewell
*Assistant Examiner*—Nhan T. Lam
*Attorney, Agent, or Firm*—Jean-Marc Zimmerman

[57] ABSTRACT

A compact having a re-useable, self-aligning valve, wherein a first one of two elements forming the seal fits over the second one of said elements, the second element being able to move in three different planes of movement in relation to the first element so that when the first element is lowered over the second element, the second element can be moved by the first element so that said elements are properly aligned with one another to form an airtight seal.

20 Claims, 2 Drawing Sheets

COMPACT WITH RE-USEABLE, SELF-ALIGNING VALVE SEAL

FIELD OF THE INVENTION

The present invention relates generally to containers and more particularly to a compact used to hold or store cosmetics, powders, emulsions, creams or other semi-solid or past type materials, wherein the compact includes a re-useable, self-aligning valve seal to provide an airtight closure.

BACKGROUND OF THE INVENTION

Containers used to store cosmetics, such as compacts, are well known in the prior art. Some compacts are airtight to prevent dry, powdery cosmetic material from absorbing moisture from the air, or conversely, to prevent super moisturized cosmetic material from losing moisture to the air. Compacts having airtight closures are well known in the prior art. See U.S. Pat. Nos. 4,454,889 and 5,186,318.

Conventional airtight compacts suffer from several drawbacks. A problem commonly encountered with such compacts is that if the compact is not properly closed, then the closure will not be airtight and the material stored therein will not be properly protected. An additional problem encountered with such compacts is that if the base and cover are not coupled to one another, the cover can be misplaced.

Valve seals are commonly used to provide airtight closures for many different types of containers. For example, valve seals are used to provide airtight seals in soda bottles, wherein the seal is formed by the bottle top and the bottle cap. In order for the valve seal of a soda bottle to provide a perfect airtight closure, the bottle top and the bottle cap must be properly aligned with one another and both the bottle top and bottle cap must be fabricated according to specified tolerances. A problem commonly encountered with containers which utilize a valve seal is that if the elements forming the seal are not properly aligned with one another and/or if the elements forming such a seal are not fabricated to specified tolerances, then the respective elements will not fit properly in relation top one another and will therefore fail to provide an airtight closure. Another problem commonly encountered with valve seals is that, for example in the case of a soda bottle, once the seal is opened it can not be closed again.

Thus, there exists a need for a compact which includes a re-useable, valve seal which eliminates the foregoing problems. It is therefore an object of the present invention to provide a compact having a re-useable, self-aligning valve seal which overcomes the foregoing drawbacks of both conventional compacts and conventional valve seals by providing a compact, wherein one of the two elements forming the seal is able to move in three different planes of movement in relation to the other element when the compact is closed so that an airtight seal can be formed.

SUMMARY OF THE INVENTION

A re-useable, self-aligning valve seal for use in compacts and/or other containers, wherein a first one of two elements forming the seal fits over the second one of said elements, the second element being able to move in three different planes of movement in relation to the first element so that when the first element is lowered over the second element, the second element can be moved by the first element so that said elements are properly aligned with one another to form an airtight seal.

DETAILED DESCRIPTION OF THE DRAWINGS

Figure 1:
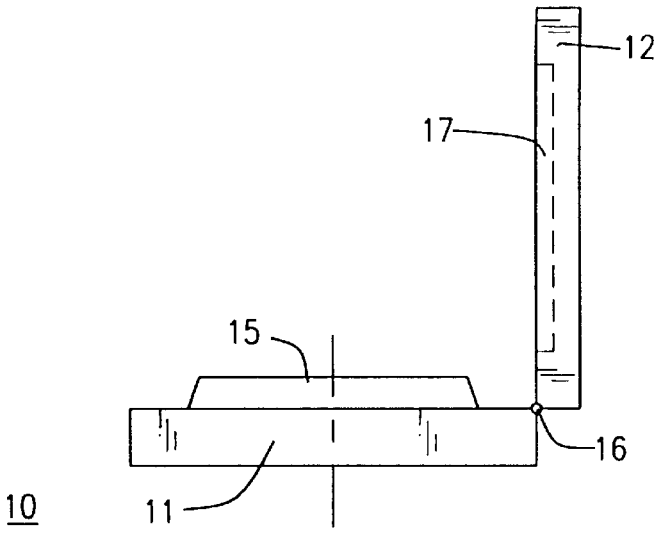
FIG. 1 shows a side view of a compact having a re-useable, self-aligning valve seal according to the present invention when the compact is open.

Referring to FIG. 1, there is shown a compact 10 having a re-useable, self-aligning valve seal according to the present invention. Compact 10 is comprised of base 11 and cover 12. Base 11 includes a recessed panshaped reservoir 13 which is positioned therein. Reservoir 13 includes lip 14 which extends outwards in base 11 from the bottom of reservoir 13. Reservoir 13 also includes tapered section 15 which protrudes upwards from the top of base 11. Base 11 is fabricated such that reservoir 13 is able to move in three planes of movement within base 11, i.e., in the horizontal, vertical and diagonal planes.

Cover 12 is coupled to base 11 by means of hinge 16, or by any other suitable coupling device. Cover 12 includes recessed area 17 which is positioned therein. The diameter of recessed area 17 is slightly greater than the diameter of tapered section 15. When compact 10 is closed by lowering cover 12 in relation to base 11, recessed area 17 surrounds tapered section 15 and can move reservoir 13 in three planes of movement so that reservoir 13 and recessed area 17 are properly aligned with one another to form an airtight seal which will protect material stored in compact 10.

The airtight seal formed by compact 10 is formed every time compact 10 is closed regardless of whether reservoir 13 and recessed area 17 are exactly fabricated to specified tolerances. In addition, since reservoir 13 is able to move in three planes of movement, an air tight seal can be assured even if compact 10 is fabricated such that reservoir 13 and recessed area 17 are not exactly aligned with one another. This also permits compacts which might otherwise be discarded as scrap to be utilized.

Compact 10 is opened by lifting cover 11 in relation to base 12. The valve seal formed by tapered section 15 and recessed area 17 can be reformed simply by re-closing compact 10.

Figure 2:
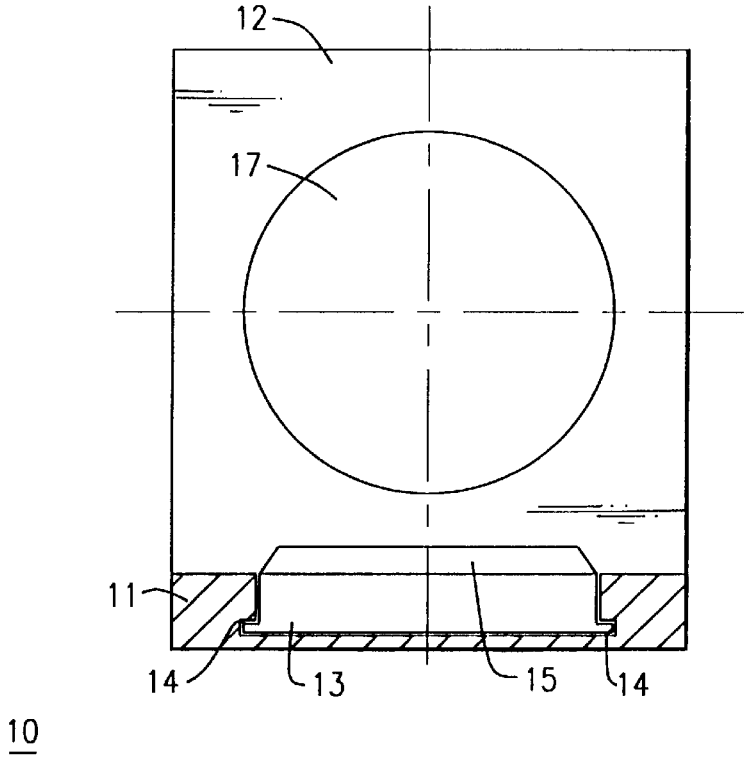
FIG. 2 shows a rear view of the compact shown in FIG. 1 when the compact is open.
Figure 3:
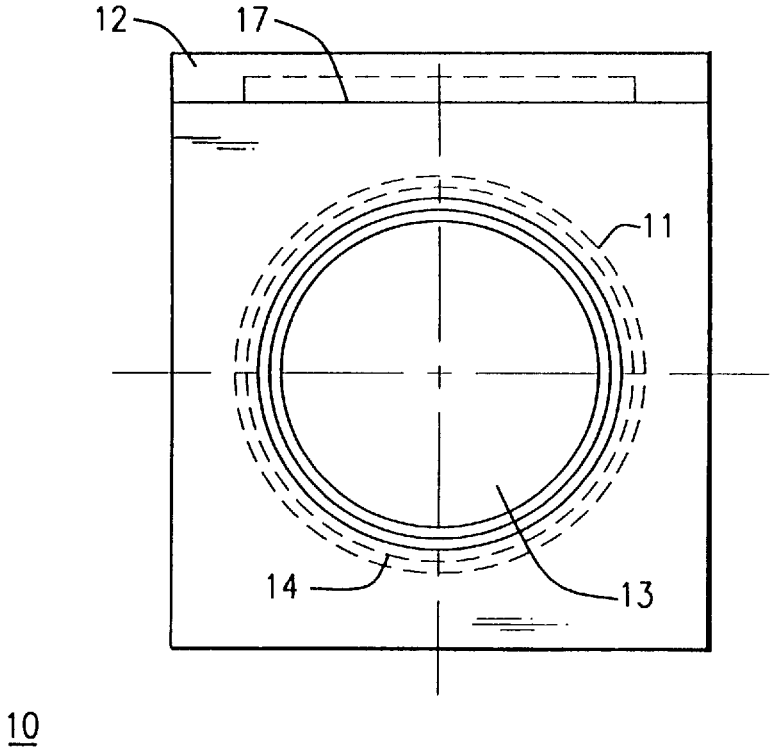
FIG.3 is a top view of the compact shown in FIG. 1 when the compact is open.

FIG. 2 shows a rear view of compact 10 when compact 10 is open. FIG.3 shows a top view of compact 10 when compact 10 is open.

Compact 10, reservoir 13, tapered section 15 and recessed area 17 can be fabricated in any desired shape or size and from any material. It will be understood that the embodiment described herein is merely exemplary and that a person skilled in the art may make many variations and modifications to the described embodiment utilizing functionally equivalent elements to that described. Any variations or modifications to the invention just described are intended to be included within the scope of said invention as defined by the appended claims.

What is claimed is:

1. A container having a re-useable, self-aligning valve seal comprising:

a base having a separate reservoir positioned therein, said reservoir having a neck extending above a top surface of said base; and a cover coupled to said base, said cover having a recessed area positioned therein, wherein when said container is closed said recessed area surrounds said neck and moves and aligns said reservoir in relation to said recessed area to provide an airtight closure.

2. The container according to claim 1, wherein said container is a compact used to hold a cosmetic.

3. The container according to claim 1, wherein said reservoir is configured for three dimensional movement in said base.

4. The container according to claim 1, wherein said neck is tapered.

5. The container according to claim 1, wherein said neck extends upwards from said base.

6. The container according to claim 1, wherein said neck and said recessed area are fabricated from polypropylene.

7. The container according to claim 6, wherein said lip is configured for three dimensional movement in said base.

8. The container according to claim 1, wherein said re-usable, self-aligning valve seal is formed every time said container is closed.

9. The container according to claim 1, wherein said re-useable, self-aligning valve seal is broken every time said compact is opened.

10. The container according to claim 1, wherein said reservoir includes a lip which extends from the bottom and side of said reservoir, said lip being positioned in said base.

11. The container according to claim 1, wherein the diameter of said recessed area is greater than the diameter of said neck.

12. The container according to claim 1, wherein said reservoir and said recessed area are round.

13. The container according to claim 1, wherein said container is a compact used to hold a cosmetic.

14. The container according to claim 1, wherein said tapered neck and said recessed area are fabricated from polypropylene.

15. The container according to claim 1, wherein said re-useable, self-aligning valve seal is formed every time said container is closed.

16. The container according to claim 1, wherein said re-useable, self-aligning valve seal is broken every time said compact is opened.

17. The container according to claim 1, wherein said reservoir includes a lip which extends from the bottom and side of said reservoir, said lip being positioned in said base.

18. The container according to claim 17, wherein said lip is configured for three dimensional movement in said base.

19. A container having a re-useable, self-aligning valve seal, comprising:

a base having a reservoir positioned therein, said reservoir including a tapered neck protruding above a top surface of said base, wherein said reservoir is configured for three dimensional movement in said base; and a cover coupled to said base, said cover having a recessed area positioned therein, the diameter of said recessed area being greater than the diameter of said tapered neck such that when said cover is lowered in relation to said base to close said container, said recessed area surrounds said tapered neck and moves said tapered neck and said reservoir to properly align said reservoir in relation to said recessed area thereby providing an airtight closure to protect material stored in said container.

20. A method of fabricating a container having a re-useable, self-aligning seal comprising the steps of:

providing a base having a reservoir positioned therein, said reservoir including a tapered neck protruding above a top surface of said base, wherein said reservoir is configured for three dimensional movement in said base; and providing a cover coupled to said base, said cover having a recessed area positioned therein, the diameter of said recessed area being greater than the diameter of said tapered neck such that when said cover is lowered in relation to said base to close said container, said recessed area surrounds said tapered neck and moves said tapered neck and said reservoir to properly align said reservoir in relation to said recessed area thereby providing an airtight closure to protect material stored in said container.

* * * * *